US006561110B1

(12) United States Patent
Fernandes et al.

(10) Patent No.: US 6,561,110 B1
(45) Date of Patent: May 13, 2003

(54) PASSIVE STABILIZER FOR FLOATING PETROLEUM-PRODUCTION SYSTEMS

(75) Inventors: Antonio Carlos Fernandes, Rio de Janeiro (BR); Mauricio Da Justa Albano De Aratanha, Rio de Janeiro (BR); Sylvio Henrique Sá Correa Da Silva, Niteroi (BR)

(73) Assignee: Petroleo Brasileiro S.A. - Petrobras (BR)

( * ) Notice: Subject to any disclaimer, the term of this patent is extended or adjusted under 35 U.S.C. 154(b) by 2 days.

(21) Appl. No.: 09/186,429

(22) Filed: Nov. 5, 1998

(30) Foreign Application Priority Data

Jun. 11, 1997 (BR) ..... 9705431

(51) Int. Cl.[7] ..... B63B 39/06

(52) U.S. Cl. ..... 114/126; 114/122; 114/230.12; 114/230.13

(58) Field of Search ..... 114/121, 122, 114/126, 56.1, 230.13, 230.12

(56) References Cited

U.S. PATENT DOCUMENTS

| | | | | | |
|---|---|---|---|---|---|
| 3,066,634 | A | * | 12/1962 | Suberkrub | 114/126 |
| 3,377,975 | A | * | 4/1968 | Field | 114/126 |
| 3,757,723 | A | * | 9/1973 | Pangalila | 114/126 |
| 4,023,516 | A | * | 5/1977 | Bennett | 114/126 |
| 4,266,496 | A | * | 5/1981 | Carlsen | 114/126 |
| 4,273,063 | A | * | 6/1981 | Berne | 114/126 |
| 4,550,673 | A | | 11/1985 | Ingvason | |
| 4,841,895 | A | * | 6/1989 | Brewerton | 114/230 |
| 4,860,680 | A | | 8/1989 | Faulconer | |
| 5,701,835 | A | * | 12/1997 | Borseth | 114/56 |
| 6,014,939 | A | * | 1/2000 | Gusmeri et al. | 114/230.12 |

FOREIGN PATENT DOCUMENTS

| | | |
|---|---|---|
| JP | 63-192688 | 8/1988 |
| WO | 96/33090 | 10/1996 |
| WO | 97/29940 | 8/1997 |

* cited by examiner

*Primary Examiner*—Stephen Avila
*Assistant Examiner*—Lars A. Olson
(74) *Attorney, Agent, or Firm*—Nixon & Vanderhye PC

(57) ABSTRACT

The present invention relates to a passive stabilizer (3) which is installed in the lower part of a tanker used in floating production systems which make use of a mechanism which enables the tanker (1) to rotate about a vertical axis (turret). The stabilizer gives the tanker greater directional stability and makes it possible to install the turret in a more central position along the tanker.

13 Claims, 4 Drawing Sheets

PASSIVE STABILIZER FOR FLOATING PETROLEUM-PRODUCTION SYSTEMS

FIELD OF THE INVENTION

The present invention relates to equipment for giving greater stability to a vessel used in floating production systems which make use of mechanisms which enable the vessel to rotate about a vertical axis (turret).

PRIOR ART

With the discovery of offshore petroleum fields, it became necessary to use new techniques to exploit these production fields. Initially, use was made of structures fixed to the seabed but emergent at the surface, for housing the equipment needed for the oil-extraction operations.

These structures use rigid ascending pipes, known by specialists as "risers", to link the petroleum well on the seabed to equipment on the structure, at the surface. This type of solution is recommended only for depths of water up to 300 meters since, for greater depths, this solution is expensive and takes a great deal of time to set up.

As new fields were being discovered in greater depths of water, new technologies appeared for solving the problem. One of these was to make use of floating platforms to accommodate the equipment needed for oil production.

Initially, platforms of the semi-submersible type were used for this function. Owing to their characteristic of having their floats below the sea surface, such platforms are little affected by the movement of the waves or other environmental conditions, such as wind and water currents. As a consequence, the semi-submersible platform may be kept on site by means of conventional mooring systems, basically anchoring lines formed by a combination of steel cables and chain-type lines cast down to the ocean floor at predetermined points and fixed by means of anchors.

In this solution, use is made of flexible ascending lines, or flexible risers, to link the various underwater oil wells to the platform. These flexible risers cost a great deal more than fixed risers but make the system so versatile that it is possible to begin production in a field only a short time after the discovery of the field.

Another solution which is being employed is the use of a conventional oil tanker equipped with a mechanism which enables the vessel to rotate about a vertical axis. This mechanism, known by specialists as a "turret", basically comprises two parts joined by a bearing which allows one part the possibility of rotating with respect to the other. The lower part of the turret is kept fixed on site by means of conventional mooring systems and the upper part is connected to the structure of the tanker by means of the bearing. In this way, the tanker can rotate about the vertical axis of the turret. In this case, also, use is preferably made of flexible risers for connecting the various underwater oil wells to the tanker, and these flexible risers normally form a free catenary between the turret and the sea bottom.

As the two parts of the turret can move with respect to each other, the risers are connected to its lower part and use is made of a multiple rotary joint (swivel) or a reel of flexible lines which are rolled up or unrolled around the upper part of the turret (drag chain) to form a connection between the two, fixed and movable, parts; in other words the above-mentioned equipment enables a connection to be made between the risers, which are kept in a fixed position with respect to the vertical axis of the turret, and the connection lines thereof on the vessel.

Owing to the fact that tankers are more sensitive to environmental conditions than semi-submersible platforms, for reasons of directional stability, the turret is normally installed on one of the ends of the vessel (bow or stem) or, alternatively, use is made of an external turret fixed to one of these ends. The positioning of the turret at the ends gives the tanker a weather-vanning capacity, i.e. the ability to align its bow to face environmental disturbances in a favorable position.

For certain headings at an excessive angle to the wind or tide, it would be extremely difficult to anchor a tanker in the open sea, especially in the case of a large-tonnage tanker, owing to the constant variations in sea conditions. However, if it were possible to position the tanker so as to maintain it aligned with the changing direction of the environmental force (winds, currents, etc.) it would, at least in its central region, behave in a similar manner to a semi-submersible. Hence the option of positioning the turret at the ends of the tanker has been provided for.

However, placing the turret at the ends of the tanker gives rise to a serious drawback, which will now be described. The longitudinal rocking movement (pitching) of the tanker as a result of wave action, which is a movement of rotation about a transverse horizontal axis which passes close to the mid ship section of the tanker, means that the ends of the tanker undergo practically linear vertical movements. The further away the turret is from the mid ship section, the greater the vertical movements will be.

As these movements are transferred in their entirety to the connection of the risers, when use is made of tankers of great length such as "supertankers" whose length is close on 320 m, fairly high values of rise and fall at the turret can easily be achieved. These movements may have disastrous effects on the risers, particularly if free-catenary risers are used, since when the movement is one of descent it is possible for there to be a compression effect, which can easily damage the risers, with disastrous results.

One solution to the problem would be to transfer the turret to a point as close as possible to the mid ship section. It is not difficult to work out that, if the turret were placed in such a position nearer the mid ship section, drag on the turret would cause the tanker to tend to lie in a transverse position with respect to an environmental force. However, it is normally under such circumstances that the effects arising from such exposure to the environmental force are most strongly felt. In addition to the force arising from the transverse exposure of the hull, undesirable transverse rocking movements (rolling) are amplified, with possible catastrophic results as to the integrity of the entire production system.

Two solutions to this problem are currently known. The first of these attempts to control the directional stability of the tanker by means of additional active forces, for example, by use of tugs which continuously exert active forces to steer the vessel into a more favorable attitude relative to environmental conditions. This effect may also be obtained by using bow thrusters located on the tanker itself. Despite being fairly effective, this solution is expensive, due basically to the high consumption of fuel to keep the engines of the tug, or the bow thrusters, in permanent operation.

Another known solution is to prevent the risers having a free-catenary configuration by using intermediate buoys or floats which interrupt the continuity of the disturbance generated by the compression of the risers caused by the combination of movements to which the tanker is subject. This would prevent the direct transmission of the vertical movements to the point of contact of the risers at the seabed (touchdown point). This solution is also fairly effective, but is also expensive and requires greater care to be taken during installation and handling.

The present invention proposes a novel solution to the problem which is effective and inexpensive, as will be seen below.

SUMMARY OF THE INVENTION

The present invention relates to a passive stabilizer for providing greater stability to a vessel used in floating production systems which make use of turret mechanisms which enable the vessel to rotate about a vertical axis.

The present invention is embodied in a vessel used in floating hydrocarbon fuel production systems, that has a turret mechanism which enables the vessel to rotate about a vertical axis relative to risers therebelow, and wherein it includes at least one projecting, passive stabilizer body on the lower part of the hull of the vessel intended to increase the vessels directional stability in relation to environmental conditions.

In a first aspect the projecting body on the lower part of the hull of the vessel is in line with the longitudinal axis of symmetry of the vessel and is preferably at one of its ends.

In a second aspect of the present invention there is a pair of projecting bodies on the lower part of the hull of the vessel located on both sides of the longitudinal line of symmetry of the vessel, and again preferably at one of its ends.

The projecting bodies may be retractable and may have end plates which are mounted transversely to them.

BRIEF DESCRIPTION OF THE DRAWINGS

The invention will now be presented in greater detail in conjunction with the drawings, mentioned below, which, purely by way of example, accompany the present specification, of which they form an integral part and in which.

DETAILED DESCRIPTION OF THE INVENTION

Figure 1:
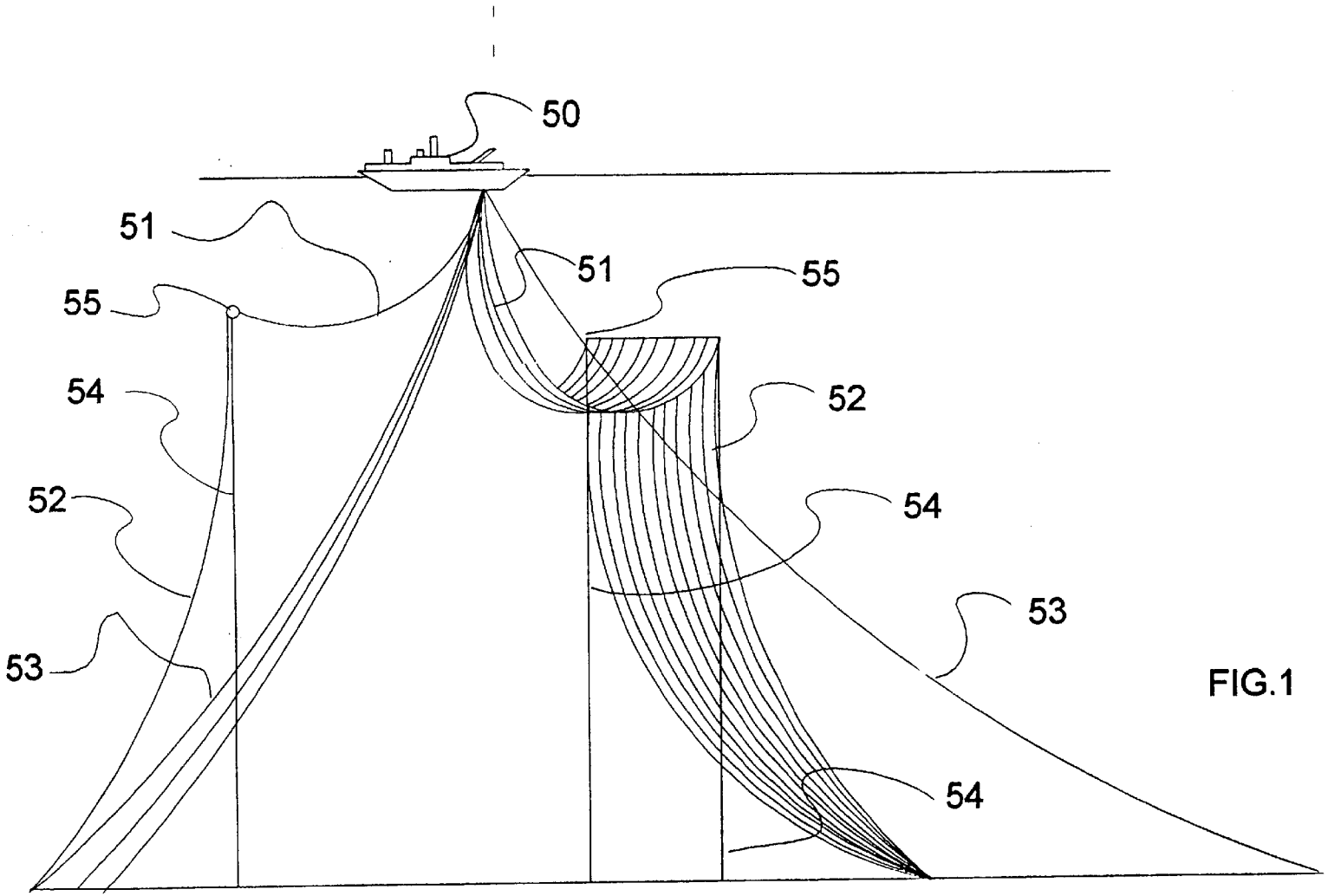
FIG. 1 is a view of a prior art floating production system using a turret on a tanker, where use is made of intermediate buoys or floats to interrupt the continuity of the disturbance generated by the compression of the risers owing to the transverse rocking (rolling) movement.

Before commencing the description of the invention, reference will be made to FIG. 1 which shows a prior art floating production system using a turret on a tanker, where use is made of intermediate buoys or floats for interrupting the continuity of the disturbance generated by the compression of the risers owing to the transverse rocking (rolling) movement of the tanker.

The tanker vessel 50 is held in position by means of anchoring lines 53 which are fixed to the lower part of the turret. There are also flexible risers 51 which start from the turret and run to large-capacity buoys 55 which are held in position (submerged) by means of tensioned cables (tethers) 54. This buoy is anchored so as to be outside (below) the zone of influence of the waves and receives free-catenary risers 52.

As the flexible risers 51 between the buoys 55 and the vessel 50 are shorter than free catenary risers which start from the turret and run direct to the seabed, and as the connection at the top is below the zone of influence of the waves, they are consequently less affected by compression than would be such free-catenary risers (not shown). As stated above, this is a good solution but is one which is fairly expensive both in terms of installation and in terms of handling.

Figure 2:
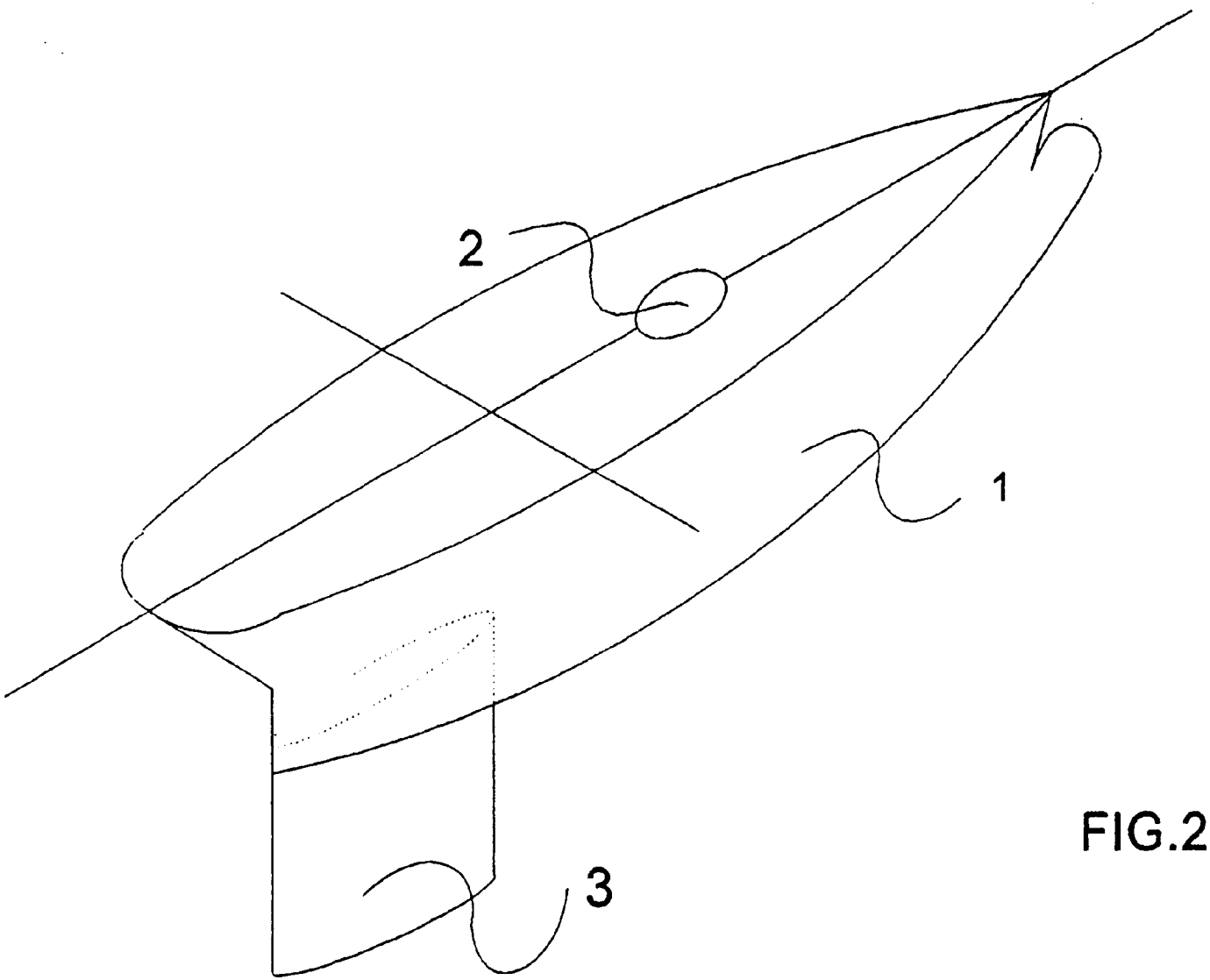
FIG. 2 is a perspective view of a first embodiment of the present invention.

FIG. 2 shows a representation of a first embodiment of the present invention which aims to solve the stability problems arising from the positioning of a turret nearer the mid ship section of a tanker. Purely for reasons of simplification only the hull is shown of a vessel 50, in this case a tanker. All its remaining components have been omitted. The turret must be positioned at a point as close as possible to the mid ship section, which is referenced 2 in FIG. 2.

To offset the loss of directional stability due to the positioning of the turret near the mid ship section, at least one passive stabilizer 3 is introduced, this being a projecting body on the lower part of the hull, preferably at one or both of the ends and in line with the tanker's longitudinal axis of symmetry.

Laboratory tests with scale models carried out by the applicant have demonstrated that the presence of the passive stabilizers actually significantly improve directional stability. The main reason for this is the fact that, bearing in mind its hydrodynamic shape which resembles a vertical wing, the passive stabilizer provides position-restoring forces.

For this reason, it is now suggested that use be made of a passive stabilizer to offset the loss of directional stability caused by the change in the position of the turret towards the mid ship section of the tanker. As a tanker in a floating production system is a tanker which stays in one location, the introduction of a passive stabilizer would not incur any penalty of increased resistance to forward movement.

However, there may be situations in which the vessel has to be easily manoeuvrable, such as during installation of the risers. To solve this problem, use may be made of a retractable passive stabilizer which may be withdrawn inside the hull when movement of the vessel is necessary. This characteristic would also make it easier to dock the vessel, since the stabilizer could be withdrawn before the vessel is placed in dry dock.

Figure 3:
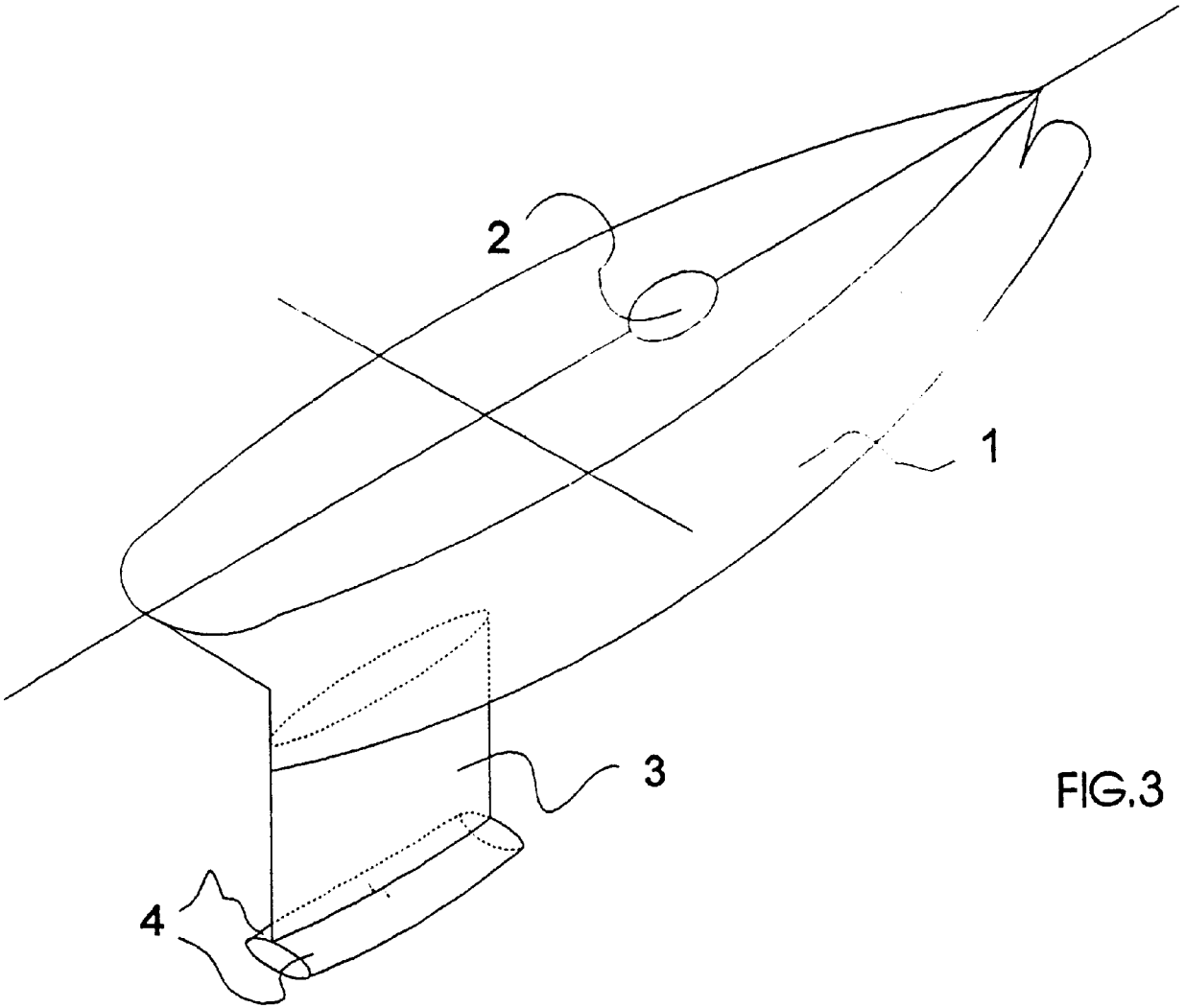
FIG. 3 is a perspective view of a second embodiment of the present invention.

FIG. 3 shows a second embodiment of the present invention. Here the vessel is a tanker 1 in which a turret is again positioned at a location 2 near the mid ship section, and in this embodiment use is made of a passive stabilizer 3 which has end plates 4 projecting perpendicular to the passive stabilizer 3. These end plates increase the stabilizing force generated, as compared with that generated by a stabilizer of the same geometry but without the end plates 4, and are used to further enhance the directional stability conferred on the vessel by the passive stabilizer.

Figure 4:
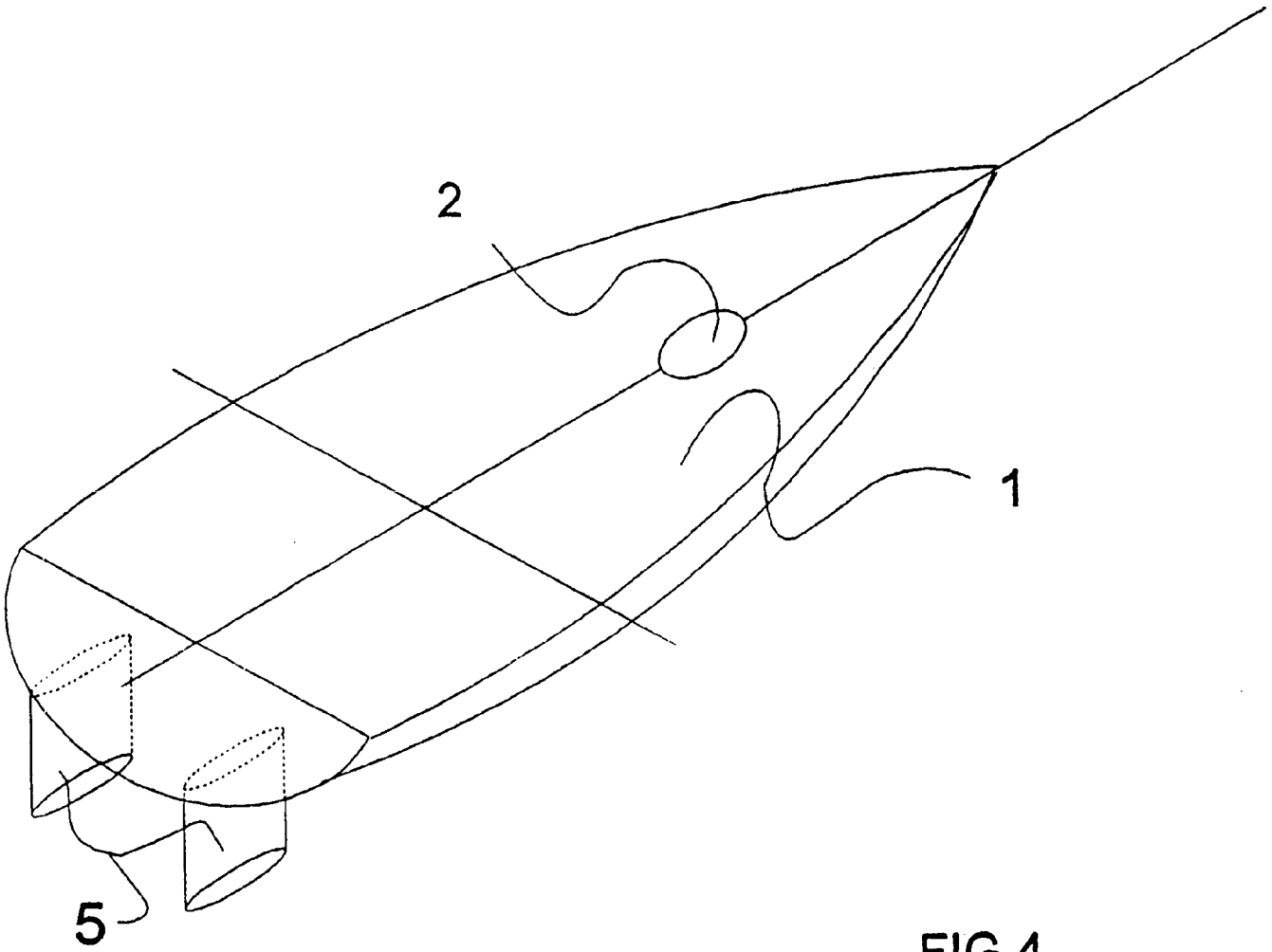
FIG. 4 is a perspective view of a third embodiment of the present invention.

FIG. 4 shows a third embodiment of the present invention. The vessel, is a tanker 1 in which a turret is positioned at a location 2 near the mid ship section; use is made of a pair of passive stabilizers, which are smaller than those of the previous embodiments. There may be more than one such pair of stabilizers, and in the respective pairs the stabilizers are located on both sides of the longitudinal line of symmetry of the vessel. In FIG. 4, the pair of passive stabilizers is located symmetrically with respect to this longitudinal line of symmetry, but this is not the only possibility since they may be located asymmetrically. With this design, the duplication of the stabilizers allows the vertical height of each one to be shorter than is the case with FIG. 2 or FIG. 3, so an attempt is made to reduce the increase in the draught of the vessel caused by the introduction of the passive stabilizer.

The embodiments shown in FIGS. 3 and 4 may also have the same retractability characteristics of the FIG. 2 embodiment, and the embodiment of FIG. 4 may also be given end plates for increased efficiency.

It should be mentioned that the hydrodynamic profile to be used in the case of the passive stabilizer, its final overall size, the decision regarding the optional use of end plates, and the decision regarding the use of a central passive stabilizer or a set of laterally spaced passive stabilizers will depend on a study of the environmental conditions at the site where the tanker will be anchored.

In order to give stability to floating production systems which use tankers equipped with a turret, the present invention introduces a new design which makes it possible to achieve a significant reduction in costs and which offers major technical advantages.

It should be mentioned that the embodiments described herein are only some of the possibilities of use of the designs of the present invention, which is not limited thereto. Other embodiments may be implemented without this departing from the spirit or scope of the present invention.

What is claimed is:

1. A vessel used in floating hydrocarbon fuel production systems, comprising a turret mechanism which enables the vessel to rotate about a vertical axis relative to risers therebelow, wherein it comprises at least one projecting passive stabilizer body on the lower part of the hull of the vessel intended to increase the vessel's directional stability in relation to environmental conditions, wherein end plates project perpendicular to the or each said passive stabilizer body to further increase efficiency and thereby to give greater directional stability to the vessel, wherein said at least one passive stabilizer body is retractable to be withdrawn inside the hull of the vessel.

2. A vessel according to claim 1, wherein the at least one passive stabilizer body is at an end of the vessel.

3. A vessel according to claim 1, wherein said turret mechanism is disposed in a vicinity of a midship section of the vessel.

4. A vessel used in floating hydrocarbon fuel production systems, comprising a turret mechanism which enables the vessel to rotate about a vertical axis relative to risers therebelow, wherein it comprises at least one vertically projecting passive stabilizer body on the lower part of the hull of the vessel for increasing the vessel's directional stability in relation to environmental conditions, wherein the vertical passive stabilizer body is in line with the vessel's longitudinal axis of symmetry and a longitudinal axis of said vertical passive stabilizer body is parallel to said vertical axis, wherein said at least one passive stabilizer body is retractable to be withdrawn inside the hull of the vessel.

5. A vessel according to claim 4, wherein end plates project perpendicular to the or each said passive stabilizer body to further increase efficiency and thereby to give greater directional stability to the vessel.

6. A vessel used in floating hydrocarbon fuel production systems, comprising a turret mechanism which enables the vessel to rotate about a vertical axis relative to risers therebelow, wherein it comprises at least one projecting passive stabilizer body on the lower part of the hull of the vessel intended to increase the vessel's directional stability in relation to environmental conditions, wherein end plates project perpendicular to the or each said passive stabilizer body to further increase efficiency and thereby to give greater directional stability to the vessel, wherein there is at least one pair of said projecting passive stabilizer bodies and the bodies of the respective pair are located to either side of the longitudinal line of symmetry of the vessel.

7. A vessel according to claim 6, wherein said at least one passive stabilizer body is retractable to be withdrawn inside the hull of the vessel.

8. A vessel used in floating hydrocarbon fuel production systems, comprising a turret mechanism which enables the vessel to rotate about a vertical axis relative to risers therebelow, wherein it comprises at least one vertically projecting passive stabilizer body on the lower part of the hull of the vessel for increasing the vessel's directional stability in relation to environmental conditions, wherein said at least one vertically projecting passive stabilizer body projects generally vertically downwardly, so as to be generally perpendicular to a horizontal plane of the vessel, wherein said at least one passive stabilizer body is selectively retractable so as to be withdrawn to an interior of the hull of the vessel.

9. A vessel according to claim 8, further comprising an end plate provided at a free end of each said passive stabilizer body and extending in a plane generally perpendicular to a plane of said respective passive stabilizer body, thereby to further increase efficiency and give greater directional stability to the vessel.

10. A vessel according to claim 8, wherein the at least one passive stabilizer body is disposed at a longitudinal end of the vessel.

11. A vessel according to claim 8, wherein the at least one passive stabilizer body is provided adjacent a stern of the vessel.

12. A vessel according to claim 8, wherein said turret mechanism is disposed in a vicinity of a midship section of the vessel.

13. A vessel used in floating hydrocarbon fuel production systems, comprising a turret mechanism which enables the vessel to rotate about a vertical axis relative to risers therebelow, wherein it comprises at least one vertically projecting passive stabilizer body on the lower part of the hull of the vessel for increasing the vessel's directional stability in relation to environmental conditions, wherein said at least one vertically projecting passive stabilizer body projects generally vertically downwardly, so as to be generally perpendicular to a horizontal plane of the vessel, wherein a pair of stabilizer bodies are provided, symmetrically disposed with respect to a longitudinal axis of the vessel and disposed in parallel to one another.

* * * * *